US012115411B2

(12) United States Patent
Harvot

(10) Patent No.: US 12,115,411 B2
(45) Date of Patent: Oct. 15, 2024

(54) AUTOMATIC BODY POSITIONING EXERCISE SUPPORT SYSTEM

(71) Applicant: Advanced Muscle Mechanics LLC, Flower Mound, TX (US)

(72) Inventor: Andrew Harvot, Flower Mound, TX (US)

(73) Assignee: Andrew Harvot, Flower Mound, TX (US)

( * ) Notice: Subject to any disclaimer, the term of this patent is extended or adjusted under 35 U.S.C. 154(b) by 285 days.

(21) Appl. No.: 17/651,988

(22) Filed: Feb. 22, 2022

(65) Prior Publication Data

US 2022/0266086 A1 Aug. 25, 2022

Related U.S. Application Data

(60) Provisional application No. 63/203,139, filed on Jul. 9, 2021, provisional application No. 63/152,903, filed on Feb. 24, 2021.

(51) Int. Cl.
*A63B 21/00* (2006.01)

(52) U.S. Cl.
CPC ..... *A63B 21/4039* (2015.10); *A63B 21/4029* (2015.10)

(58) Field of Classification Search
CPC ..... A63B 21/4039; A63B 21/4029; A63B 21/0726; A63B 21/078; A63B 2208/0238;
(Continued)

(56) References Cited

U.S. PATENT DOCUMENTS 4,319,747 A 3/1982 Rogers
4,474,370 A 10/1984 Oman
(Continued)

FOREIGN PATENT DOCUMENTS

AU 2021105042 A4 9/2021
GB 2425269 B 5/2010
GB 2580965 A 8/2020

OTHER PUBLICATIONS

Biscarini, et al, "A Scott Bench with Ergonomic Thorax Stabilization Pad Improves Body Posture During Preacher Arm Curl Exercise," Ergonomics, vol. 59, pp. 1-23, Jul. 2015, <https://www.researchgate.net/publication/280584061_A_Scott_Bench_with_Ergonomic_Thorax_Stabilization_Pad_Improves_Body_Posture_During_Preacher_Arm_Curl_Exercise>.
(Continued)

*Primary Examiner* — Loan B Jimenez
*Assistant Examiner* — Andrew M Kobylarz
(74) *Attorney, Agent, or Firm* — Thompson Patent Law Offices PC

(57) ABSTRACT

Apparatus and associated methods relate to a body positioning and support system having shoulder support surfaces (SSSs) and a lumbar support surface (LSS) offset downwards from a torso support surface (TSS). In an illustrative example, the TSS extends in a first plane along a longitudinal axis. An SSS may, for example, extend from each side of the TSS in opposite directions along a transverse axis orthogonal to the longitudinal axis in the first plane. The LSS may, for example, be distal to the TSS. The SSSs may, for example, each be defined by a first offset from the first plane towards a base plane. The LSS may, for example, be displaced from the first plane towards the base plane by at least a second offset. A neck support surface may extend from a proximal end of the TSS. Various embodiments may advantageously automatically position and support (targeted) body anatomy.

20 Claims, 11 Drawing Sheets

(58) Field of Classification Search
CPC ..... A63B 2208/0252; A63B 23/0417; A63B 2210/50; A63B 2208/0261; A61G 7/065; A61G 7/07; A61G 13/12; A61G 13/126; A61G 13/129; A47C 20/02
See application file for complete search history.

(56) References Cited

U.S. PATENT DOCUMENTS

| | | | | |
|---|---|---|---|---|
| 4,621,809 | A | 11/1986 | Pearl | |
| 5,007,633 | A | 4/1991 | Lemire | |
| 5,348,523 | A | 9/1994 | Blount | |
| 5,447,481 | A | 9/1995 | Emter | |
| RE35,083 | E | 11/1995 | Roosevelt | |
| 5,649,886 | A | 7/1997 | Danylieko | |
| 6,030,324 | A * | 2/2000 | McBride | A63B 21/4029 482/142 |
| 7,322,911 | B2 * | 1/2008 | Webber | A63B 23/0211 482/142 |
| 8,568,281 | B2 * | 10/2013 | Beaulieu | A63B 21/4029 482/142 |
| 9,345,924 | B2 | 5/2016 | Crawley et al. | |
| 10,814,158 | B2 | 10/2020 | Mancias | |
| 10,857,417 | B2 | 12/2020 | Jagessar | |
| 11,844,733 | B1 * | 12/2023 | Augustine | A61G 13/126 |
| 2003/0220176 | A1 * | 11/2003 | O'Connor | A63B 21/4029 482/142 |
| 2006/0116262 | A1 * | 6/2006 | Pandozy | A63B 23/0216 482/142 |
| 2007/0155605 | A1 * | 7/2007 | Hockemeyer | A63B 21/4029 482/142 |
| 2011/0136635 | A1 | 6/2011 | Berc | |
| 2011/0224059 | A1 * | 9/2011 | Crawley | A63B 21/4029 482/142 |
| 2014/0342888 | A1 | 11/2014 | Cecil | |
| 2015/0246259 | A1 * | 9/2015 | Stoesslein | A63B 21/4029 482/142 |
| 2017/0274243 | A1 * | 9/2017 | Lorca | A63B 69/0057 |
| 2018/0369633 | A1 * | 12/2018 | Baker | A63B 23/0211 |
| 2019/0262659 | A1 | 8/2019 | Jagessar | |
| 2022/0314059 | A1 | 10/2022 | Rojas | |

OTHER PUBLICATIONS

Borges, et al "Comparative evaluation of muscular activation and scapular kinematics in a chest press lever machine and a barbell bench press," JPES, vol. 19, No. 3, pp. 912-916, May 2019, doi: 10.7752/jpes.2019.s3131.
Rogue Fitness, "Thompson Fat Pad," Rogue Fitness, retrieved from the internet Jun. 29, 2021, <https://www.roguefitness.com/thompson-fatpad>.
We Sell Mats, "2 X 6 Personal Exercise Mat," We Sell Mats, retrieved from the internet Jun. 29, 2021, <https://www.wesellmats.com/2-x-6-personal-exercise-mat/>.
Edge Fitness Systems, Elevation Pads, accessed Oct. 16, 2023, https://edgefitnesssystems.com/products/elevation-pads.
International Preliminary Report on Patentability in related International Application No. PCT/US2022/070761, dated Sep. 7, 2023, 9 pages.
Thompson, D, The Fat Archie Prototype, Instagram, accessed Sep. 7, 2023, https://www.instagram.com/thompsonbowtie/.
Facebook messages from David Barth Sep. through Nov. 2022.
Merchantgenius, Scapufix, Shopify Store Listing, retrieved from the internet Sep. 30, 2022, https://www.merchantgenius.io/shop/url/scapufix.com.
Rojas, N, Scapufix, Instagram Post, 1 Page.
Scapufix, About Us, scapufix.com, retrieved from the internet, https://scapufix.com/pages/about-us.
Scapufix, Introducing Scapufix, YouTube.com, Jul. 11, 2022, retrieved from the internet https://www.youtube.com/watch?v=0pwRusneCxs.
International Search Report and Written Opinion of the International Searching Authority in related International Application No. PCT/US2022/070761, dated May 31, 2022, 11 pages.
Thompson, D, The Fat Archie, accessed Feb. 5, 2024, https://www.instagram.com/reel/C240XUXuxuW/.

* cited by examiner

AUTOMATIC BODY POSITIONING EXERCISE SUPPORT SYSTEM

CROSS-REFERENCE TO RELATED APPLICATIONS

This application claims the benefit of U.S. Provisional Application Ser. No. 63/203,139, titled "Automatic Positioning and Support Mechanism for Use with Weightlifting Equipment," filed by Andrew Harvot on Jul. 9, 2021. This application also claims the benefit of U.S. Provisional Application Ser. No. 63/152,903, titled "Biomechanical Positioning Exercise Apparatus," filed by Andrew Harvot on Feb. 24, 2021.

This application incorporates the entire contents of the foregoing application(s) herein by reference.

TECHNICAL FIELD

Various embodiments relate generally to bodily support and positioning.

BACKGROUND

The human body is designed for various forms of motion. For example, the human body is designed to ambulate (e.g., walk, run). The human body is, for example, provided with various anatomical portions designed to extend, retract, rotate, and/or otherwise move. In various configurations, the human body may apply force.

People may desire to exercise such capabilities of the human body. For example, some people enjoy performing physical exercise for pleasure. Some people perform physical exercise for health. Some people perform physical exercise to prepare themselves for a specific task (e.g., an occupation, a sport).

When exercising, people may utilize various tools. For example, people may lift weights (e.g., dumbbells, hand weights, leg weights). People may orient themselves in various configurations, such as, for example, to specifically target motion and/or force on selected (groups of) anatomy (e.g., muscles, bones). People may use benches, frames, and/or machines (e.g., resistance devices) during exercise.

SUMMARY

Apparatus and associated methods relate to a body positioning and support system having shoulder support surfaces (SSSs) and a lumbar support surface (LSS) offset downwards from a torso support surface (TSS). In an illustrative example, the TSS extends in a first plane along a longitudinal axis. An SSS may, for example, extend from each side of the TSS in opposite directions along a transverse axis orthogonal to the longitudinal axis in the first plane. The LSS may, for example, be distal to the TSS. The SSSs may, for example, each be defined by a first offset from the first plane towards a base plane. The LSS may, for example, be displaced from the first plane towards the base plane by at least a second offset. A neck support surface may extend from a proximal end of the TSS. Various embodiments may advantageously automatically position and support (targeted) body anatomy.

Various embodiments may achieve one or more advantages. For example, a positioning and support device (PSD) may automatically position and support a user performing exercises (e.g., bench-pressing). In some embodiments, for example, a PSD may be configured to position and support a user in one or more biomechanically advantageous positions for one or more exercise regimens. A PSD may, by way of example and not limitation, advantageously position a user for safe and/or effective bench press exercises. For example, a PSD may advantageously induce scapular adduction and/or scapular depression in a user during a bench press while maintaining support beneath the scapulae during support.

In some embodiments, a PSD may, for example, advantageously support a user's head on a plane lower than the user's spine is supported on during a bench press. A PSD may, for example, advantageously provide lumbar support during an exercise (e.g., a bench press, prone exercise, leg press).

In some embodiments, a proximal positioning surface may support a user's skull such that the cervical spine is substantially aligned with a longitudinal axis that is parallel to a longitudinal axis of the PSD. Accordingly, for example, greater muscle recruitment may be achieved during weightlifting (e.g., bench pressing). In some embodiments, a proximal positioning surface may, for example, advantageously induce a user to 'tuck' their chin onto the (declined) surface to maintain spinal alignment such as, for example, during a chest-supported/prone row.

Various embodiments may, for example, be advantageously configured to naturally induce a 'natural arch' in the user's spine (e.g., when the user is resting on their back). Inducement of an arch may, for example, increase power during weightlifting. A distal positioning surface may, for example, be aligned with a user's hips. Accordingly, a user's feet may be more 'planted,' and, therefore, may advantageously reduce energy leakage during weightlifting. Such a bodily positioning may also advantageously encourage use of leg drive during lifting.

A lateral positioning surface may, for example, position a scapula of a user (e.g., in a bench press configuration) such that the scapula is automatically adducted and depressed by the user into when beginning to lift a weight. Accordingly, proper form may be advantageously automatically enforced. Such embodiments may, for example, thereby advantageously increase safety and/or power production during weightlifting. Proper form enforced by a PSD may, for example, advantageously align more chest fibers with a path of a bar (e.g., of a barbell).

Various embodiments may advantageously induce a natural curve in the lumbar spine. For example, a lumbar module and/or thorax module(s) may be advantageously configured to position and/or support a lumbar spine of a user in a desired configuration.

Some embodiments may, for example, be configured to advantageously augment a 'standard' weightlifting bench to provide a biomechanically advantageous weightlifting apparatus.

Some embodiments may, for example, be advantageously operated into a stowage and/or transport mode.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, an exemplary positioning and support device (PSD) is introduced with reference to FIGS. 1-2C. Second, that introduction leads into a description with reference to FIGS. 3-10 of some exemplary embodiments of a PSD. Third, with reference to FIGS. 11-12, an exemplary PSD is described in application to various illustrative use-cases. Fourth, with reference to FIG. 13, the discussion turns to exemplary embodiments that illustrate a built-in PSD. Finally, the document discusses further embodiments, exemplary applications and aspects relating to PSDs.

Figure 1:
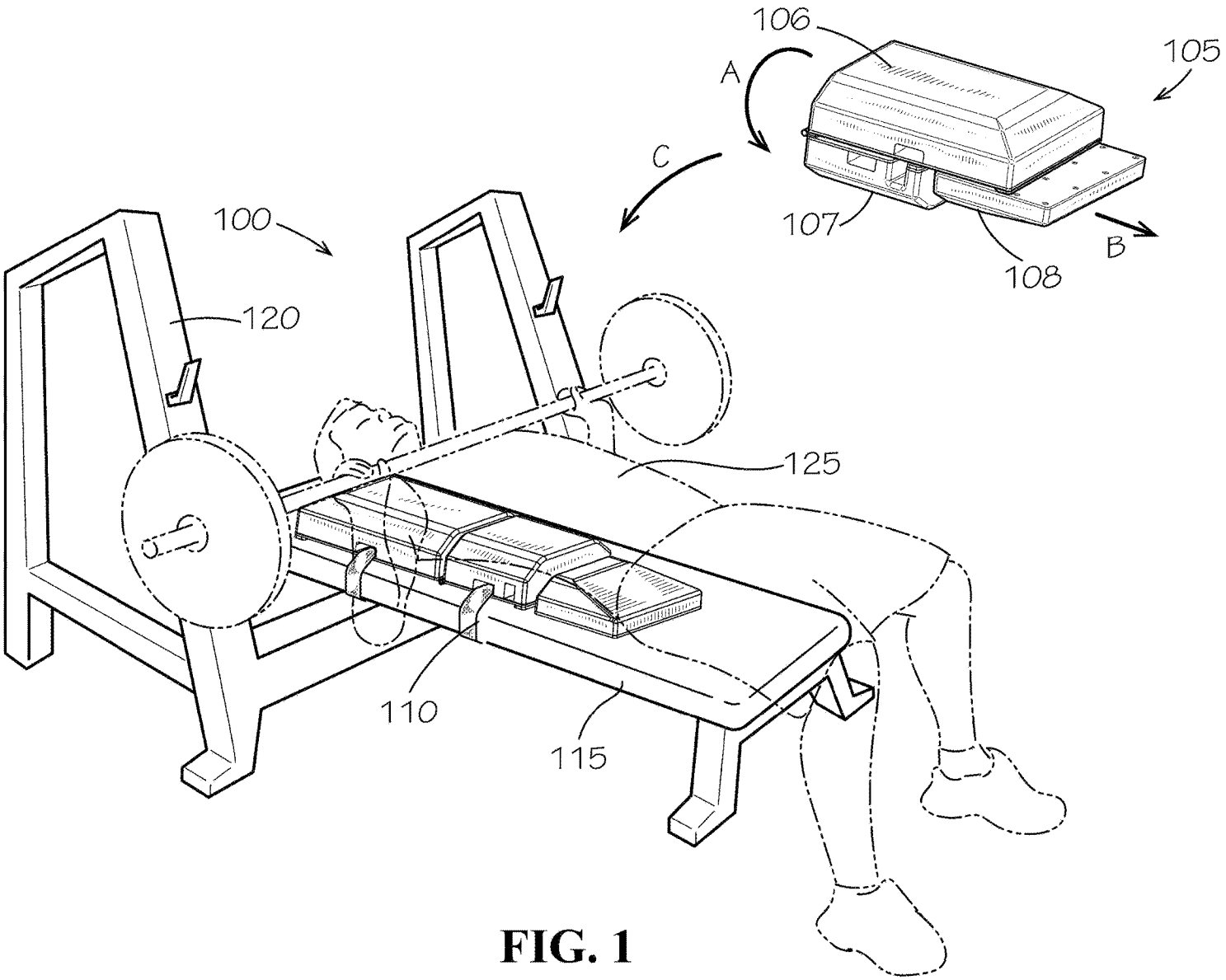
FIG. 1 depicts an exemplary positioning and support device (PSD) employed in an illustrative use-case scenario of bench-pressing.

FIG. 1 depicts an exemplary positioning and support device (PSD) employed in an illustrative use-case scenario of bench-pressing. In the depicted scenario 100, a PSD 105 is depicted, in a top right portion of the figure, in a transport mode. As depicted, in the transport mode, the PSD 105 is folded substantially in half. Accordingly, the PSD 105 may, for example, be advantageously stowed (e.g., in a backpack, duffel bag, briefcase, vehicle, closet), transported (e.g., in a vehicle, carried by a person), or some combination thereof.

The PSD 105 includes an upper torso module 106, a lower torso module 107, and a lumbar module 108. The PSD 105 may be operated into a deployed mode. In the depicted example, the PSD 105 is unfolded (e.g., as depicted by motion "A") from the transport mode to the deployed mode. The lumbar module 108 is adjusted (e.g., as depicted by motion "B") relative to the lower torso module 107 such as, by way of example and not limitation, to fit a user 125.

In the depicted example, once the PSD 105 is in the deployed mode, the PSD 105 is operated into a bench mode (e.g., as depicted by motion "C"). In the depicted bench mode, the PSD 105 is releasably coupled by multiple (e.g., two) coupling members 110 (e.g., elastic straps, adjustable straps, buckled straps, hook-and-loop straps) to a bench 115 (e.g., a weightlifting bench). In the exemplary illustration, the bench 115 is disposed on a free weight bench press frame 120. Accordingly, the PSD 105 may, for example, be used to augment a 'standard' weightlifting bench to provide a biomechanically advantageous weightlifting apparatus. The PSD 105 may, for example, as depicted, automatically position and support the user 125 when the user 125 is performing exercises (e.g., bench-pressing, as depicted).

The PSD 105 may, for example, be configured to position and support a user in one or more biomechanically advantageous positions for one or more exercise regimens. The PSD 105 may, by way of example and not limitation, advantageously position a user for safe and/or effective bench press exercises. For example, the PSD 105 may advantageously induce scapular retraction (also referred to as scapular adduction) and/or scapular depression in a user during a bench press while maintaining support beneath the scapula during support. The PSD 105 may, for example, advantageously support a user's head on a plane lower than the user's spine is supported on during a bench press. The PSD 105 may, for example, advantageously provide lumbar support during a bench press.

Figure 2A:
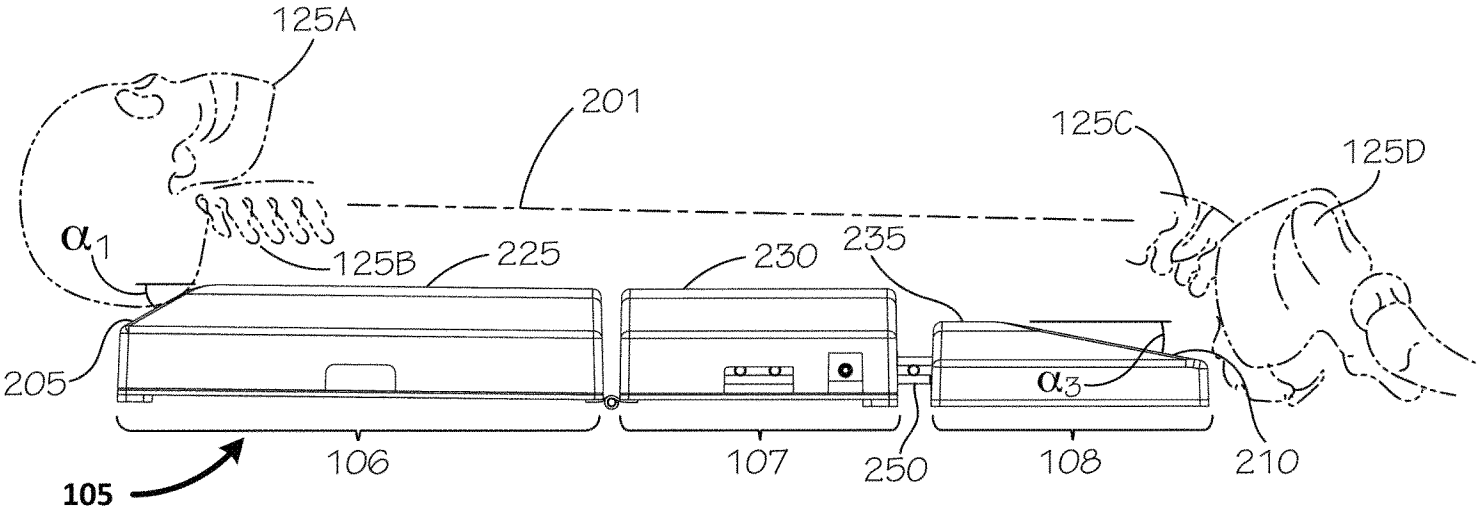
FIG. 2A, FIG. 2B, and FIG. 2C depict a left side elevation view and end elevation views, respectively, of the exemplary PSD, with illustrative skeletal positioning of the user during the illustrative use-case depicted in FIG. 1.
Figure 2B:
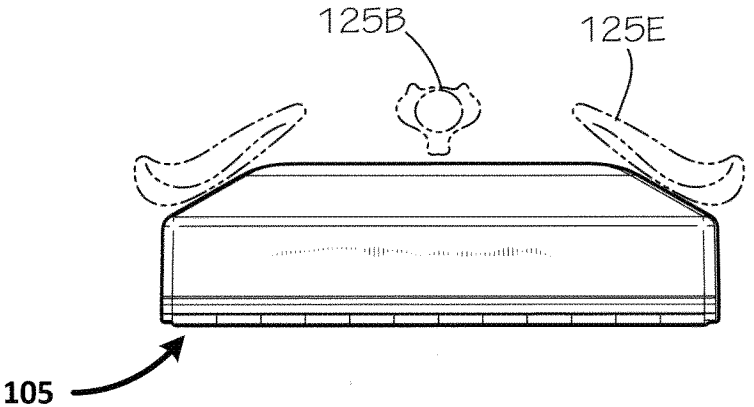
Figure 2C:
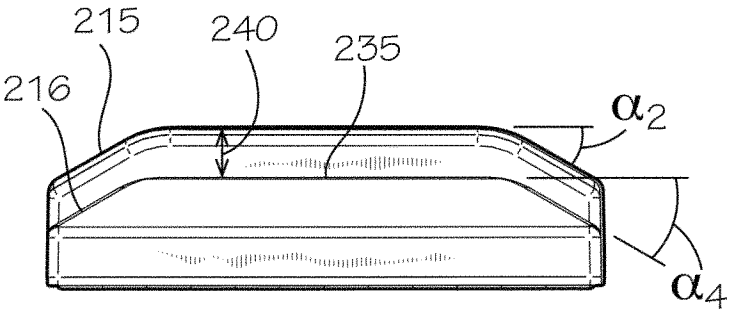
Figure 11:
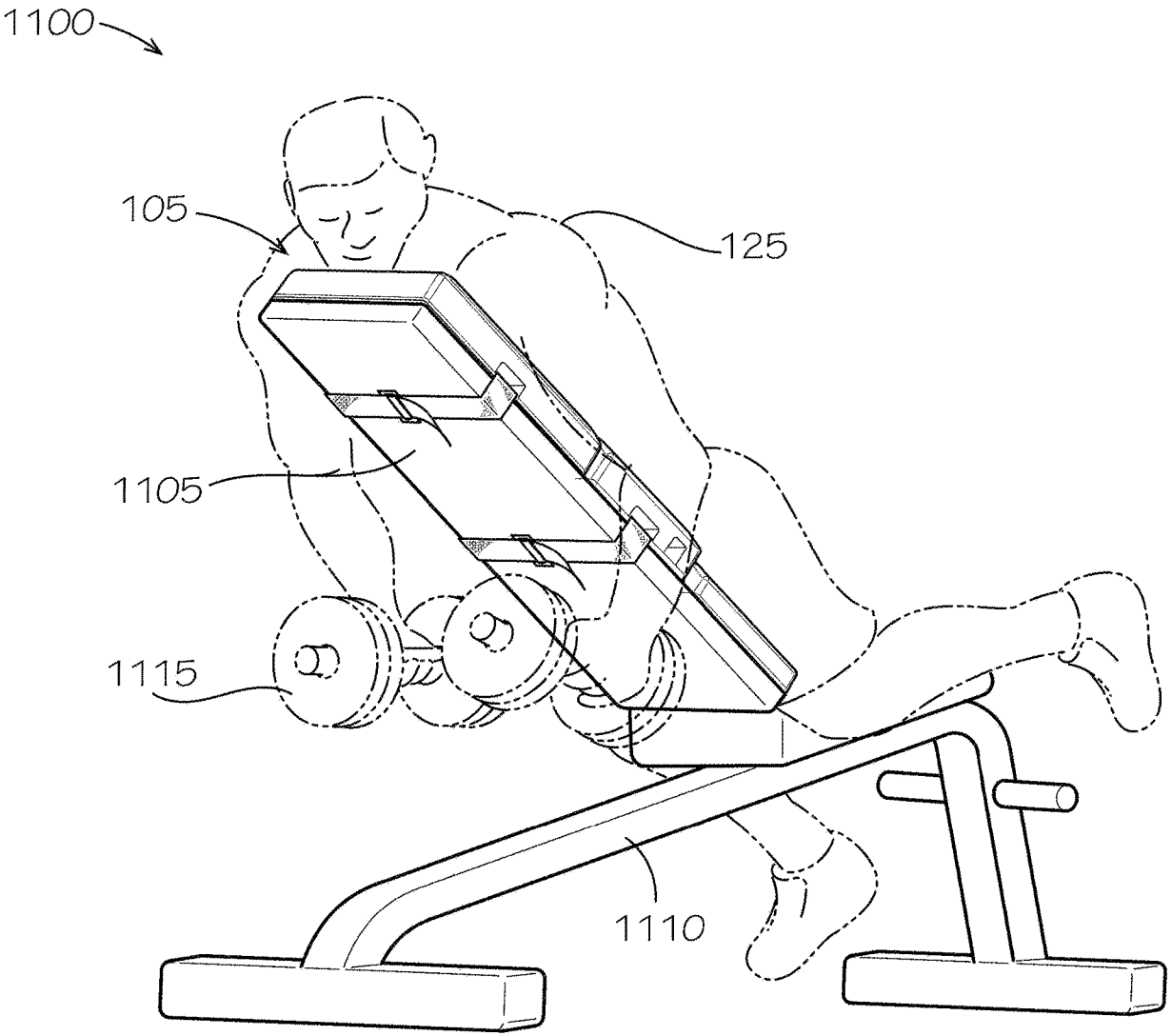
FIG. 11 depicts an exemplary PSD in an illustrative use-case scenario on an exercise bench.

FIG. 2A, FIG. 2B, and FIG. 2C depict a left side elevation view and end elevation views, respectively, of the exemplary PSD, with illustrative skeletal positioning of the user during the illustrative use-case depicted in FIG. 1. The upper torso module 106 is provided with a proximal positioning surface 205. The proximal positioning surface 205 may, for example, be configured to at least partially receive and/or position a user's head and/or neck. As depicted in the illustrative skeletal orientation depicted in FIG. 2A of the use-case scenario disclosed at least with reference to FIG. 1, a user's head (depicted by skull 125A) may rest at least partially on the proximal positioning surface 205. In some scenarios, for example, the skull 125A may rest proximal to the proximal positioning surface 205. The proximal positioning surface 205 may, for example, support the cervical spine 125B of the user 125 in a target orientation. For example, the proximal positioning surface 205 may support the skull 125A such that the cervical spine 125B is substantially aligned with a longitudinal axis 201 that is parallel to a longitudinal axis of the PSD 105. In a bench press scenario (e.g., the user's back is resting on the PSD 105, such as depicted in FIG. 1), the proximal positioning surface 205 may position and/or support the user's neck such that the user's head is tilted back (e.g., the cervical spine 125B is at least partially supported in a plane below the thoracic spine). The proximal positioning surface 205 may support the skull 125A such that the cervical spine 125B is substantially aligned with a longitudinal axis 201 that is parallel to a longitudinal axis of the PSD 105. Accordingly, greater muscle recruitment may be achieved during weightlifting (e.g., bench pressing). The proximal positioning surface 205 may, for example, advantageously allow a user to 'tuck' their chin onto the (declined) surface without being out of spinal alignment such as, for example, during a chest-supported/prone row (e.g., as shown in FIG. 11).

The lumbar module 108 is provided with a distal positioning surface 210. The distal positioning surface 210 may, for example, be configured to at least partially receive, position, and/or support the lumbar region of a user's back. For example, the lumbar spine 125C of the user 125 may be at least partially supported and/or positioned by the distal positioning surface 210 and the upper (flat) surface of the lumbar module 108.

The distal positioning surface 210 may, for example, position the user's spine such that the pelvis 125D of the user 125 is at least partially supported in a lower plane than their thoracic spine and/or lumbar spine 125C. The distal positioning surface 210 may, for example, position the user's spine such that that their lumbar spine 125C is at least partially supported in a lower plane than their thoracic spine. Accordingly, various embodiments may advantageously induce a 'natural arch' in the user's spine (e.g., when the user is resting on their back). Inducement of an arch may, for example, increase power during weightlifting. The distal positioning surface 210 may, for example, be aligned with the user's hips (e.g., as shown with respect to the pelvis 125D). Accordingly, a user's feet may be more 'planted,' and, therefore, may advantageously reduce energy leakage during weightlifting. Such a bodily positioning may also advantageously encourage use of leg drive during lifting.

The upper torso module 106, lower torso module 107, and lumbar module 108 are each provided with a left and right lateral positioning surface 215. Each lateral positioning surface 215 may be configured, for example, to at least partially receive, position, and/or support a corresponding scapula of a user. For example, the user's left and right scapula may be at least partially supported and/or positioned by the respective left and right lateral positioning surface 215. The lateral positioning surface 215 may, for example, position the scapulae 125E of the user 125 (e.g., in a bench press configuration such as depicted in FIG. 1) such that the scapulae 125E are automatically adducted and depressed by the user 125 into a configuration such as shown in FIG. 2B when beginning to lift (e.g., bench press) a weight. Accordingly, proper form may be advantageously automatically enforced. Such embodiments may, for example, thereby advantageously increase safety and/or power production during weightlifting. Proper form enforced by the PSD 105 may, for example, advantageously align more chest fibers with a path of a bar (e.g., of a barbell).

In various embodiments an upper surface of the upper torso module 106, lower torso module 107, and/or lumbar module 108 between the lateral positioning surface 215, proximal positioning surface 205, and/or distal positioning surface 210 may be substantially flat (e.g., planar). As depicted, the upper torso module 106 is provided with a (planar) support surface 225 between the proximal positioning surface 205 and the lateral positioning surfaces 215. The lower torso module 107 is provided with a (planar) support surface 230 between the lateral positioning surfaces 215. The lumbar module 108 is provided with a (planar) support surface 235 between the distal positioning surface 210 and the lateral positioning surfaces 215.

In the depicted example, the support surface 235 is in a lower plane than the support surface 230 and the support surface 225. The support surface 235 is offset from the support surface 225 and the support surface 230 by a distance 240. In various embodiments the distance 240 may, by way of example and not limitation, be substantially 0.5, 0.75, 1, 1.25, 1.5, or 2 inches. Various embodiments may advantageously induce a natural curve in the lumbar spine.

In some embodiments, such as depicted, the lateral positioning surface 215 (e.g., shoulder support surface(s)) extends laterally, in a transverse axis to the longitudinal axis of the PSD 105, from a side (e.g., each side) of the support surface 225. The lateral positioning surface 215 is offset downwards, by a first offset, from the support surface 225 towards a base plane of the PSD 105. In various embodiments, for example, the base plane may be at least partially defined as a plane in which an upper torso frame member 320 extends, parallel to the longitudinal axis 201, such as disclosed at least with reference to FIG. 3. In some embodiments, the base plane may be at least partially defined as a top surface of an exercise bench (e.g., as depicted in FIG. 1).

The first offset may, for example, be increasing with increasing distance from the longitudinal axis along the transverse axis. The first offset may, for example, be monotonically increasing. As depicted, the first offset is linearly increasing. For example, as depicted, the first offset is linearly increasing as defined by an angle $\alpha_2$ relative to the plane defined by the support surface 225.

In some embodiments, $\alpha_2$ may be equal on both sides of the support surface 225. In some embodiments, $\alpha_2$ may be a first value on a first side of the support surface 225 and a second value (e.g., not equal to the first value) on a second side of the support surface 225.

In some embodiments, such as depicted, the support surface 235 (e.g., a lumbar support surface) may be parallel to the support surface 225. In some embodiments, such as depicted, the distal positioning surface 210 may extend from a distal edge of the support surface 235. The distal positioning surface 210 is offset downwards, by a second offset from the support surface 225 (e.g., a lumbar support surface). The second offset may, for example, be increasing with increasing distance from the distal edge of the support surface 235. The second offset may, for example, be monotonically increasing. As depicted, the second offset is linearly increasing. For example, as depicted, the second offset is linearly increasing as defined by an angle $\alpha_3$ relative to the plane defined by the support surface 235. In some embodiments, $\alpha_3$ may, by way of example and not limitation, be equal to $\alpha_2$. In some embodiments, $\alpha_3$ may, by way of example and not limitation, be a different value than $\alpha_2$.

In some embodiments, by way of example and not limitation, the support surface 235 may, for example, be omitted. In some embodiments, by way of example and not limitation, the distal positioning surface 210 may be omitted. For example, the distal positioning surface 210, the support surface 235, or some combination thereof, may act as a lumbar positioning and/or support surface.

In some embodiments, such as depicted, the proximal positioning surface 205 (e.g., a neck support surface) extends proximally from a proximal edge of the support surface 225. The proximal positioning surface 205 is offset downwards, by a third offset, from the support surface 225 towards the base plane of the PSD 105. The third offset may, for example, be increasing with increasing distance from the proximal edge of the support surface 225. For example, the third offset may be monotonically increasing. In some embodiments, such as depicted, the third offset may be linearly increasing. For example, as depicted, the third offset is linearly increasing as defined by an angle $\alpha_1$ relative to a plane defined by the support surface 225. In some embodiments, $\alpha_1$ may, by way of example and not limitation, be equal to $\alpha_2$ and/or $\alpha_3$. In some embodiments, $\alpha_1$ may, by way of example and not limitation, be a different value than $\alpha_2$ and/or $\alpha_3$.

In some embodiments, such as depicted, a lateral support surface(s) 216 may be provided. In the depicted example, the lateral support surface 216 extends along an axis parallel to the transverse axis from (e.g., each side) of the support surface 235. The lateral support surface 216 may, for example, be offset downwards, by a fourth offset, from the support surface 235 towards the base plane. For example, the fourth offset may be increasing with increasing distance from the longitudinal axis. The fourth offset may, for example, be monotonically increasing. As depicted, the fourth offset is linearly increasing. For example, as depicted, the fourth offset is linearly increasing as defined by an angle $\alpha_4$ relative to the plane defined by the support surface 235. In some embodiments, $\alpha_4$ may, by way of example and not limitation, be equal to $\alpha_1$, $\alpha_2$, and/or $\alpha_3$. In some embodiments, $\alpha_4$ may, by way of example and not limitation, be a different value than $\alpha_1$, $\alpha_2$, and/or $\alpha_3$.

Figure 3:
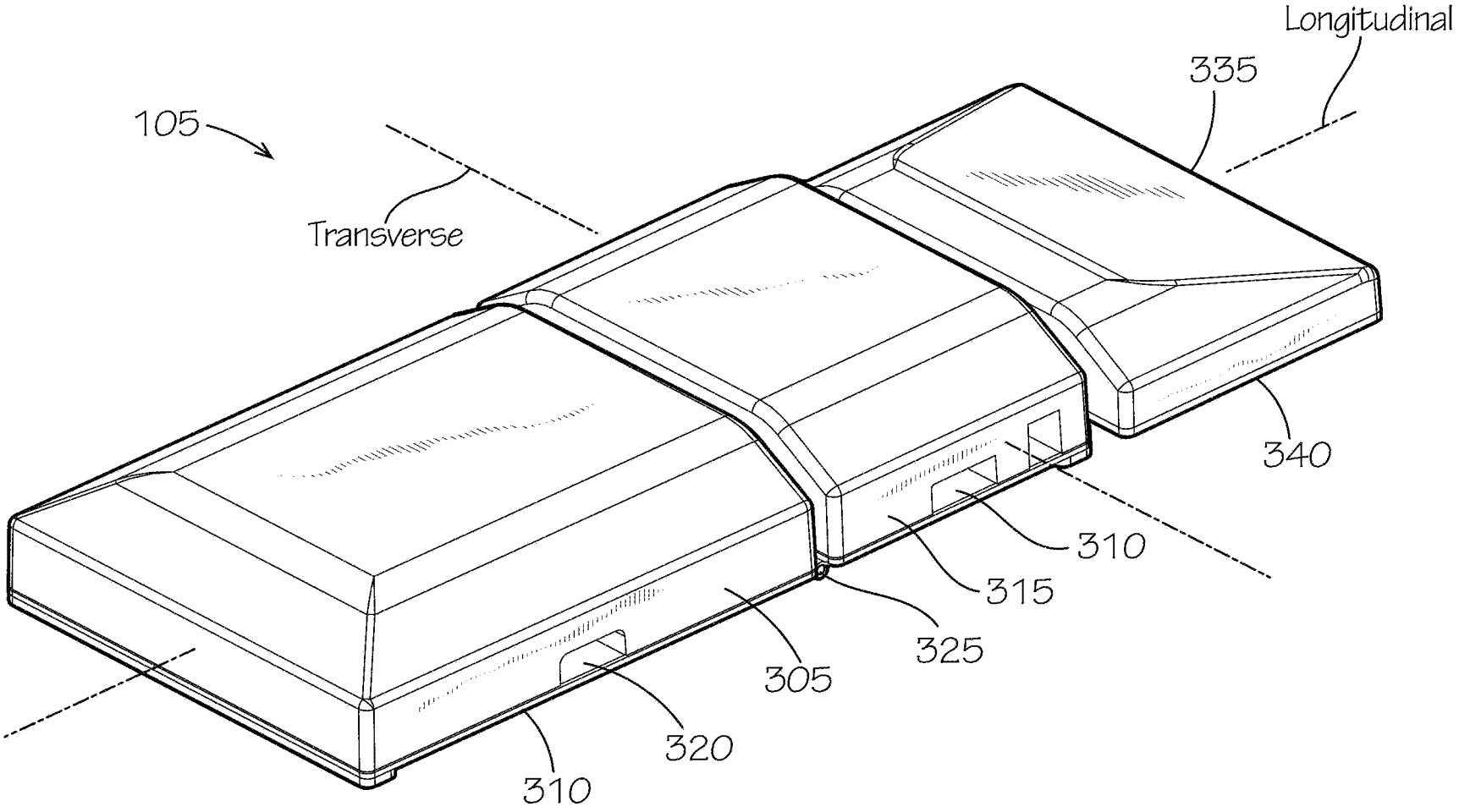
FIG. 3 depicts a perspective view of an exemplary PSD.

FIG. 3 depicts a perspective view of an exemplary PSD. The upper torso module 106 includes an upper torso support and positioning member 305 coupled to an upper torso frame member 320. The lower torso module 107 includes a lower torso support and positioning member 315 coupled to a lower torso frame member 310. The upper torso frame member 320 and the lower torso frame member 310 are rotatably coupled by a hinge member 325.

The lower torso module 107 is slidingly coupled to the lumbar module 108 by an extension member 250. Lumbar module 108 includes a lumbar support and positioning member 335 and a lumbar frame member 340.

Figure 4:
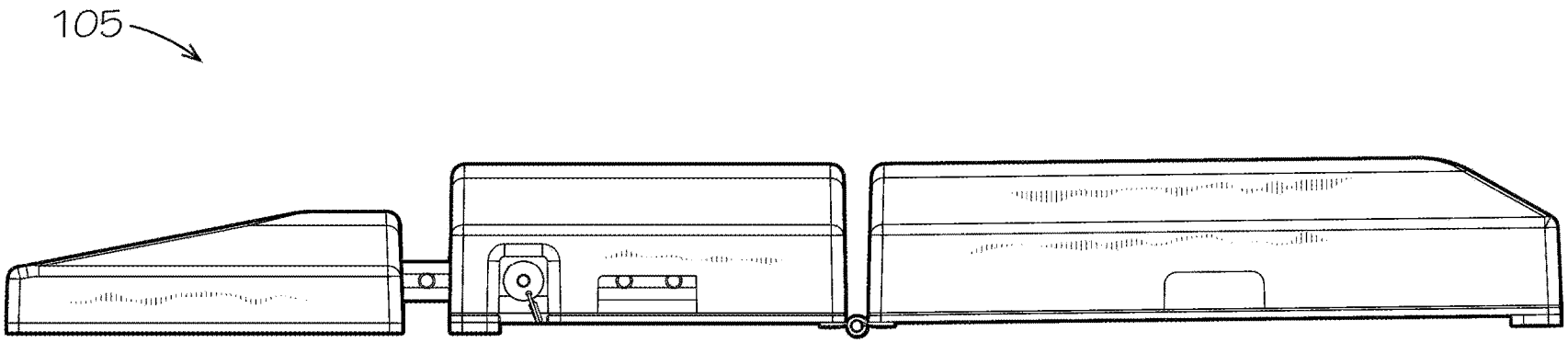
FIG. 4 depicts a right-side elevation view of the exemplary PSD.
Figure 5:
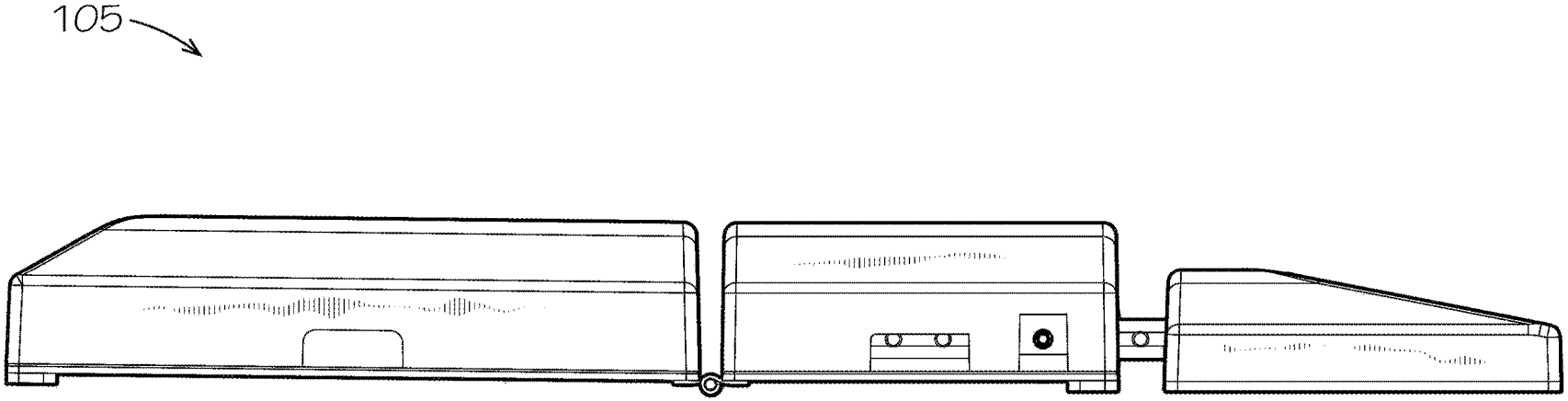
FIG. 5 depicts a left side elevation view of the exemplary PSD.

FIG. 4 and FIG. 5 depict sectional views of the exemplary PSD. An upper perspective longitudinal cross-sectional view and a lower perspective longitudinal cross-sectional view depict the extension member 250 slidingly coupled with a receiving member 1010. The extension member 250 and receiving member 1010 are releasably coupled by a coupling member 910 (e.g., a pin), as shown in lateral cross-sectional view. The coupling member 910 may, for example, have a retention member (e.g., a spring-loaded ball) at a distal end. Accordingly, the coupling member 910 may be advantageously retained in a coupled configuration until (purposely) removed (e.g., by a user). Accordingly, an effective length of the PSD 105 may be advantageously adjusted (e.g., for different users such as having different torso lengths, different benches, different exercises).

Figure 6:
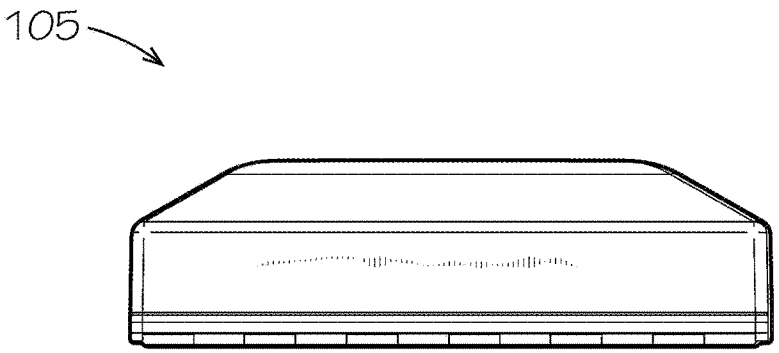
FIG. 6 depicts a (cranial) end elevation view of the exemplary PSD.
Figure 7:
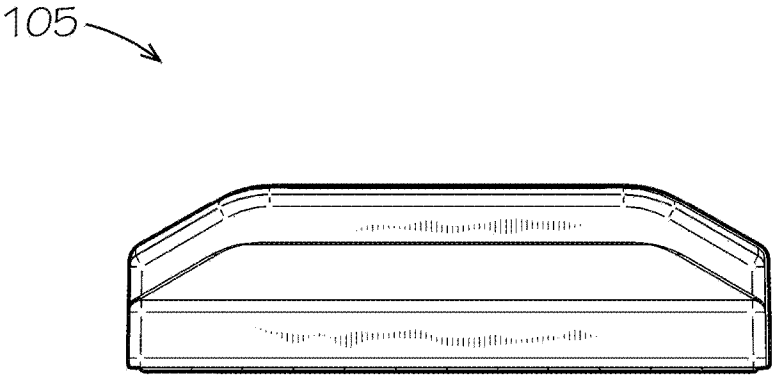
FIG. 7 depicts a (caudal) end elevation view of the exemplary PSD.
Figure 8:
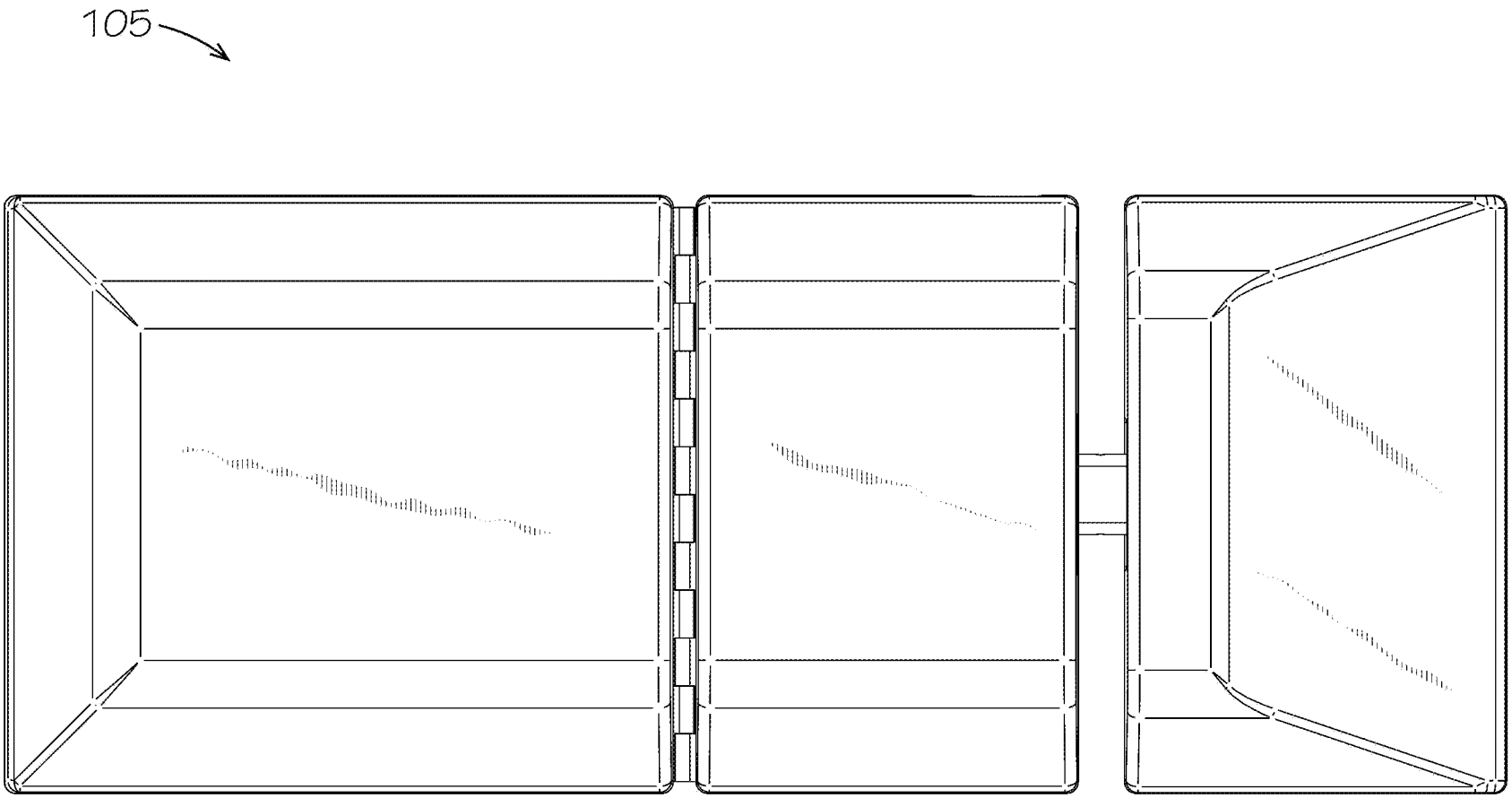
FIG. 8 depicts an exemplary top plan view of the exemplary PSD.
Figure 9:
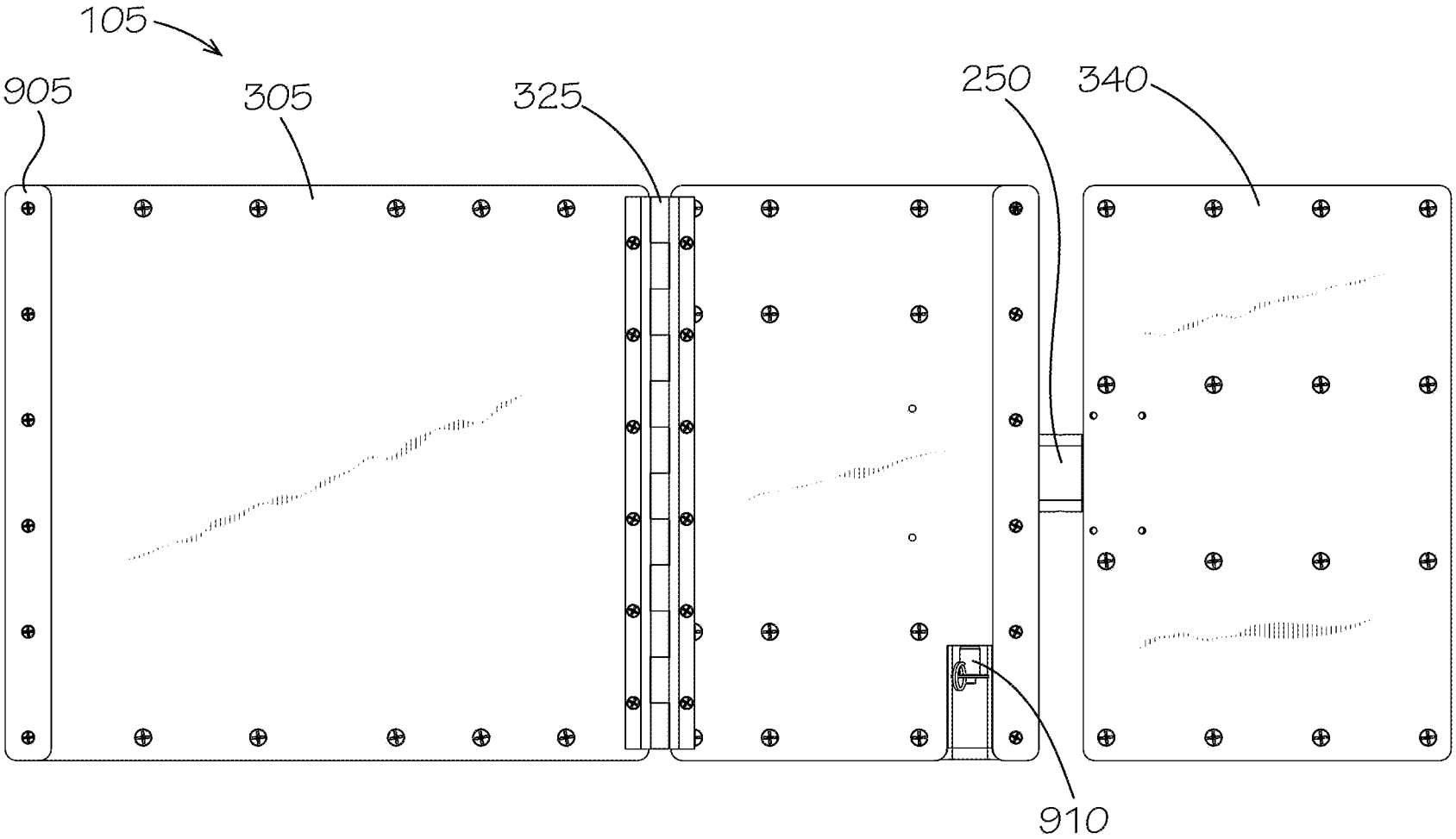
FIG. 9 depicts an exemplary bottom plan view of the exemplary PSD.

FIG. 4 depicts a right-side elevation view of the exemplary PSD. FIG. 5 depicts a left side elevation view of the exemplary PSD. FIG. 6 depicts a (cranial) end elevation view of the exemplary PSD. FIG. 7 depicts a (caudal) end elevation view of the exemplary PSD. FIG. 8 depicts an exemplary top plan view of the exemplary PSD. FIG. 9 depicts an exemplary bottom plan view of the exemplary PSD.

Spacers 905 are provided in the depicted example. The spacers 905 may, for example, be configured to have an effective thickness substantially equivalent to an effective thickness of the hinge member 325. Accordingly, the PSD 105 may lie substantially flat in the deployed mode and/or bench mode.

In some embodiments, one or more of the spacers 905 may, by way of example and not limitation, be hinged. For example, a spacer 905 may be operated to selectively adjust a height and/or angle of a portion of the PSD 105. In some embodiments, a spacer 905 may, for example, be manually adjustable. In some embodiments, for example, a spacer 905 may be electromechanically adjustable (e.g., by a motor, in response to operation of an input device from a user). Accordingly, an angle and/or height of one or more portions of the PSD 105 may, for example, be selectively adjusted by a user.

Figure 10:
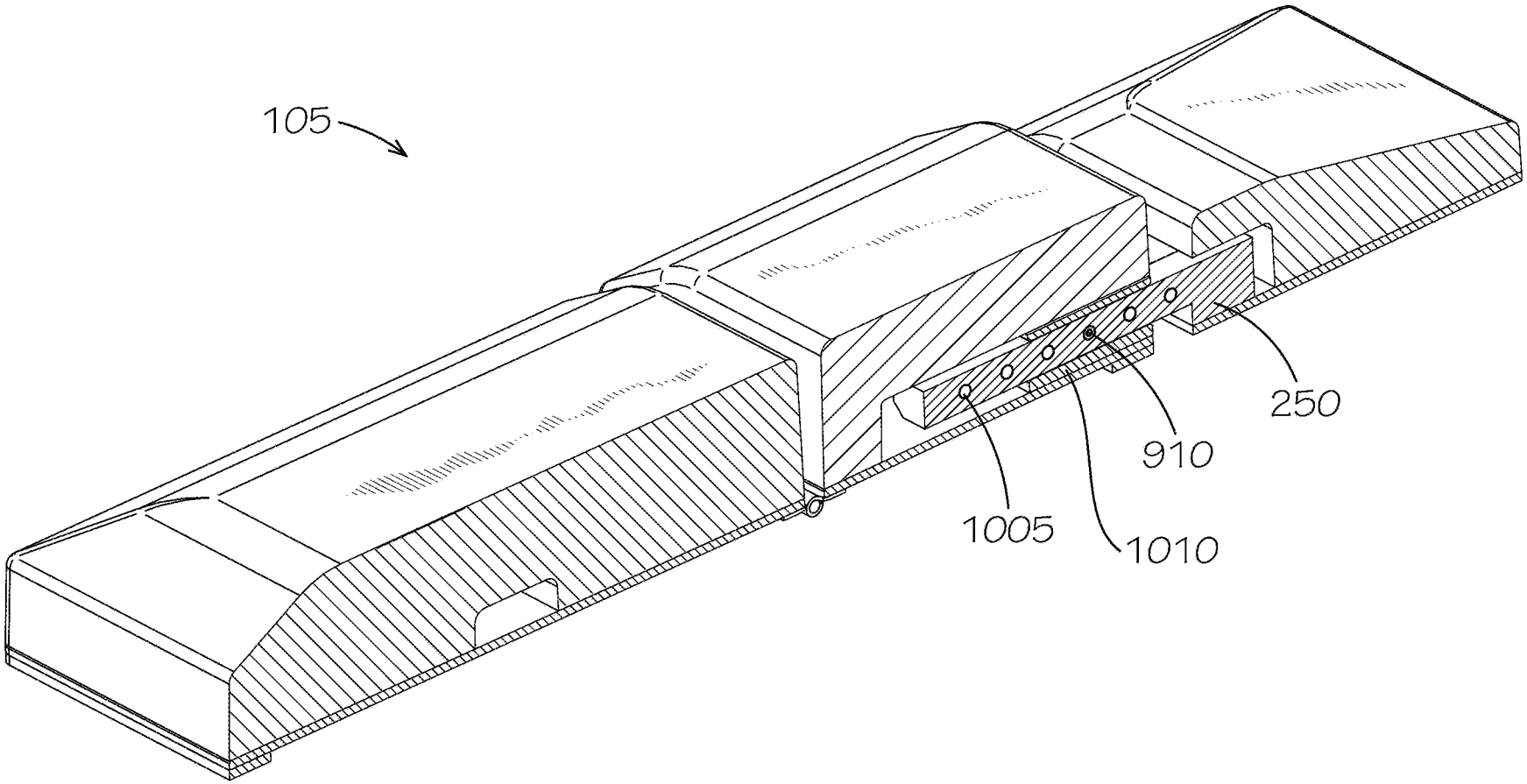
FIG. 10 depicts an exemplary cross-section view along a longitudinal axis.

FIG. 10 depicts an exemplary cross-section view along a longitudinal axis. The extension member 250, as depicted, is provided with multiple channels 1005 configured to receive a coupling member 910 (e.g., a pin). The lumbar module 108 may, for example, thereby be releasably coupled into various (predetermined) configurations extended distally away from or retracted proximally towards the lower torso module 107. For example, as depicted, the coupling member 910 may releasably couple the extension member 250 (by a channel 1005) to a receiving member 1010 embedded in the lower torso module 107. In some embodiments, by way of example and not limitation, the receiving member 1010 may be provided with a stopping member (e.g., wall) such that a distal end of the coupling member 910 is limited in travel. Such embodiments may, for example, advantageously allow a user to insert a pin without having to deal with overtravel.

FIG. 11 depicts an exemplary PSD in an illustrative use-case scenario on an exercise bench. In the depicted exemplary scenario 1100, the PSD 105 is (releasably) coupled to an existing bench 1105 of an exercise device 1110. The user 125 is positioned chest-down against the PSD 105. A chin of the user 125 is positioned against the proximal positioning surface 205. Accordingly, for example, the PSD 105 may automatically induce the user 125 to maintain a desired spinal alignment during operation of weights 1115 (e.g., during a row exercise).

Figure 12:
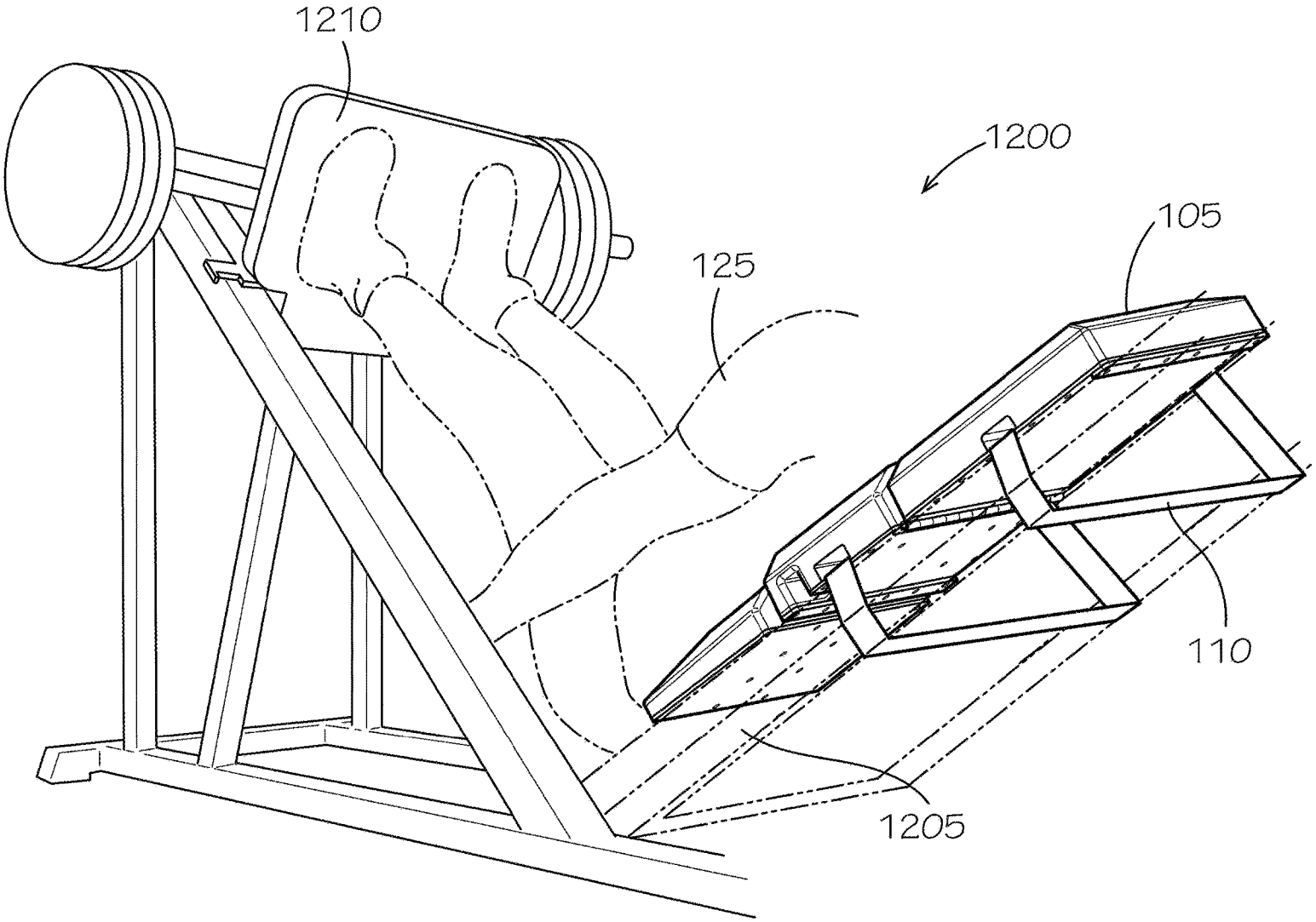
FIG. 12 depicts an exemplary PSD in an illustrative use-case scenario on a leg press machine.

FIG. 12 depicts an exemplary PSD in an illustrative use-case scenario on a leg press machine. In the depicted exemplary scenario 1200, the PSD 105 is (releasably) coupled, by the coupling members 110, to an existing user support 1205 of a leg press machine. The PSD 105 (automatically) positions and supports the user 125 while the user 125 presses their legs against a weight lift device 1210. The proximal positioning surface 205 and/or the distal positioning surface 210 may, by way of example and not limitation, cooperate to align and/or support a spine of the user 125 (e.g., cervical spine and/or lumbar spine support) to increase power and/or decrease risk of injury.

Figure 13:
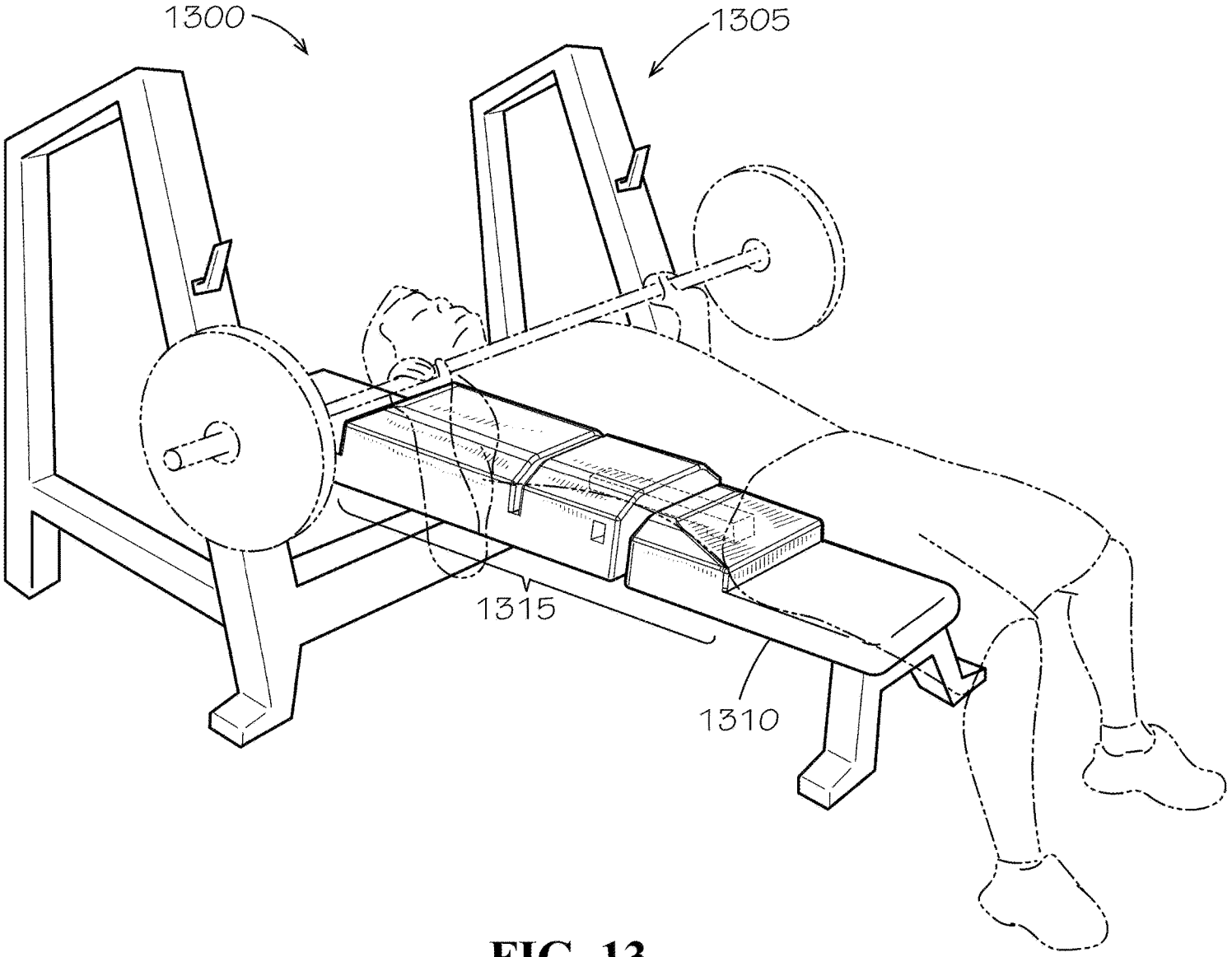
FIG. 13 depicts an exemplary machine-integrated PSD in an illustrative use-case scenario.

The PSD 105 may, for example, advantageously provide lumbar support to position and support, for example, at least a lumbar region spine. For example, a distal end of the PSD 105 may advantageously prevent buttocks of the user 125 from rolling and/or 'riding up.' Such embodiments may, for example, advantageously reduce lower back pain. FIG. 13 depicts an exemplary machine-integrated PSD in an illustrative use-case scenario. In the depicted exemplary scenario 1300, an exercise system 1305 has a bench 1310. The bench 1310 includes a PSD 1315 (e.g., configured such as disclosed at least with reference to the PSD 105). The PSD 1315 may, for example, as depicted, be integrated into the bench 1310. Various embodiments may be integrated into equipment such as, for example, a purchaser may receive from an original equipment manufacturer (OEM). Various such embodiments may, by way of example and not limitation, include one or more adjustment mechanisms (e.g., integrated into a bench/equipment, BPD, or some combination thereof). Such adjustments may, for example, allow a user to adjust at least one of angle and curvature by, for example, setting adjusting knobs and/or actuating (electromechanical) actuators.

Although various embodiments have been described with reference to the figures, other embodiments are possible. For example, although an exemplary system has been described with reference to the figures, other implementations may be deployed in other industrial, scientific, medical, commercial, and/or residential applications.

For example, in various embodiments, (such as disclosed at least with reference to FIG. 8 of U.S. Provisional Application Ser. No. 63/203,139, filed by Andrew Harvot on Jul. 9, 2021, the entirety of which is incorporated herein by reference), one or more portions of a PSD (e.g., the PSD 105) may be provided with angle and/or height adjustments. An upper torso module (e.g., the upper torso module 106) may, for example, be adjustably inclined (e.g., with respect to the longitudinal and/or transverse axis). For example, an upper torso module may be supported by an adjustable support member (e.g., 'kickstand,' rotating cam, inflatable support member).

An upper torso module may, for example, be adjustable declined. For example, an upper torso module, a lower torso module (e.g., the lower torso module 107), and/or a lumbar module (e.g., the lumbar module 108) may be supported in the desired configuration by a positioning member and/or support member. A positioning member may, for example, be a (inflatable) wedge (e.g., having an adjustable width and/or angle). The member may, for example, be adjustable (e.g., adjustable position kickstand, rotating cam, inflatable support member). Accordingly, various embodiments may advantageously permit a user to operate a PSD into a desired configuration (e.g., in the deployed mode and/or the bench mode).

In some embodiments (e.g., such as disclosed at least with reference to FIG. 5 of U.S. Provisional Application Ser. No. 63/203,139, filed by Andrew Harvot on Jul. 9, 2021, the entirety of which is incorporated herein by reference), the upper torso support and positioning member 305, the lower torso support and positioning member 315, and/or the lumbar support and positioning member 335 may be provided with receiving members. The members 305, 315, and/or 335 may, by way of example and not limitation, be over-molded onto the receiving members, the receiving members may be inserted into the respective member(s), or some combination thereof. Each frame member (e.g., upper torso frame member 320, lower torso frame member 310, lumbar frame member 340) is (releasably) coupled to the corresponding support and positioning member by coupling members. Each coupling member may be (releasably) coupled to a corresponding receiving member (e.g., threadedly coupled, pressingly coupled). In some embodiments, the receiving members may expand in response to (threaded) engagement by a corresponding coupling member.

In various embodiments an angle (e.g., $\alpha_1$, $\alpha_2$, $\alpha_3$, $\alpha_4$) of a lateral positioning surface (e.g., lateral positioning surface 215), a proximal positioning surface (e.g., the proximal positioning surface 205), and/or the distal positioning surface 210 relative to the corresponding upper surface (e.g., a planar top surface) may, by way of example and not limitation, be 20 degrees. Such an angle may, for example, be at least about 25 degrees. Such an angle may, for example, be at least about 30 degrees. Such an angle may, for example, be at least about 35 degrees. Such an angle may, for example, be at least about 40 degrees. Such an angle may, for example, be at least about 45 degrees. Such an angle may, for example, be at least about 50 degrees. Such an angle may, for example, be between 20-50 degrees. Such an angle may, for example, be between 25-35 degrees. In some embodiments, at least some of the angles may, for example, be substantially equal. In some embodiments at least some of the angles may, for example, be different values. In some embodiments, at least one such angle may, for example, be a compound angle (e.g., a first angle for a first portion, a second angle for a second portion, a varying angle such as given by a mathematical equation).

In some embodiments, an angle of at least about 20-25 degrees may provide for a desired combination of width of a top surface and width of a PSD (e.g., the PSD 105). In some embodiments an angle less than or equal to 35 degrees may, by way of example and not limitation, advantageously ensure support of a scapula (e.g., scapulae 125E) during lifting of a weight.

In various embodiments a proximal positioning surface (e.g., the proximal positioning surface 205), a distal positioning surface (e.g., the distal positioning surface 210), and/or a lateral positioning surface (e.g., the lateral positioning surface 215) may, by way of example and not limitation, be linear (as depicted). Such a surface may, for example, be curvilinear. Such a surface may, for example, be contoured.

In some embodiments an upper (planar) surface of an upper torso module (e.g., the upper torso module 106), a lower torso module (e.g., the lower torso module 107), and/or a lumbar module (e.g., the lumbar module 108) may be configured with a width sufficient to provide stability during exercise (e.g., prevent rolling). In some embodiments, the width may, by way of example and not limitation, be substantially 8 inches wide. In some embodiments, the overall width of a PSD (e.g., the PSD 105) may, by way of example and not limitation, be substantially 12.5 inches wide.

In various embodiments one or more frame members (e.g., upper torso frame member 320, lower torso frame member 310, lumbar frame member 340, extension member 250, lumbar frame member 340) may, by way of example and not limitation, be at least partially metal. In various embodiments, one or more frame members may, for example, be at least partially polymer. Suitable frame materials may include, by way of example and not limitation, metal (e.g., aluminum, steel). Suitable frame material may include, by way of example and not limitation, engineering polymers (e.g., nylon, reinforced nylon, ABS).

In various embodiments the member 305, member 315, and/or member 335 may, by way of example and not limitation, be at least partially constructed of foam. The foam may, for example, be high-density and/or closed cell foam. The foam may, by way of example and not limitation, be polyurethane. In some embodiments the foam may have a density of between 0.24-0.3 grams per $cm^3$. Accordingly, various embodiments may advantageously provide an easily carried PSD 105. For example, in some embodiments a PSD 105 may be 20 pounds or less. Some embodiments may, for example, be provided with a carrying bag.

In some embodiments a hardness of the member 305, member 315, and/or member 335 may, for example, have a durometer of between 50 Shore A 70 Shore A. For example, some embodiments may have a durometer of 50, 55, 60, 65, and/or 70 Shore A. In some embodiments a positioning and support member may have a core with a higher durometer than an outer covering. The covering may be releasably or permanently disposed about the core (e.g., zippered, hook-and-loop, drawstring, over-molded, adhered).

In various embodiments an outer surface of a positioning and support member may be textured and/or friction producing relative to a user's skin and/or clothing. Various embodiments may accordingly prevent slippage of the user during use. Various embodiments may, for example, be oil and/or water resistant.

In various embodiments a positioning of a PSD 105 on a bench in a bench mode may be according to user preference. For example, the PSD 105 may be positioned a user-determined distance away from a (proximal) end of a bench. Accordingly, a user may advantageously select a comfortable and/or mechanically advantageous position (e.g., for positioning their head, chin, buttocks, legs).

In various embodiments the upper torso module 106 and lower torso module 107 may be releasably coupled. For example, the upper torso module 106 and lower torso module 107 may be separable into two distinct pieces (e.g., in a transport mode). In a deployed mode and/or bench mode the upper torso module 106 and lower torso module 107 may, for example, be coupled by a coupling member (e.g., a pin).

A muscle building exercise may begin with set up and stabilization. Setup may be a key to ensure the muscle being worked is, in fact, the prime mover. Stability may be a key to efficient movements and/or hard contractions. The human body may allow other body parts to assist and take over if it senses any instability. A user's ability to set up and stabilize correctly may dictate whether or not the muscle being targeted is the muscle that initiates the movement. Accordingly, various embodiments may advantageously induce proper set up and/or stabilization. Various embodiments may advantageously enforce proper form for a user without requiring preexisting knowledge and/or conscious effort to remind themselves. Proper set up and stabilization may directly correlate with the use of proper form, efficient biomechanics, and/or injury prevention. Various embodiments may, for example, create a platform for more biomechanically efficient movements where the use of proper form is instinctual and/or the common injuries less frequent.

Various embodiments may, for example, be configured as a custom, multipurpose, exercise bench "retrofit" pad. Such embodiments may, for example, fit securely on a bench and/or position a user in a biomechanically advantageous position, regardless of whether the user is on their back or their stomach, to engage a barbell or set of dumbbells. Various embodiments may be deployed, for example, as an accessory to exercise benches and/or machines, to promote the use of proper form, efficient biomechanics, and/or injury prevention during exercise. Various such embodiments may be configured to be extremely versatile. For example, various PSDs may be configured to work on a variety of original equipment benches and/or exercise machines.

Various embodiments may include, for example, an upper torso section, a lower torso section, and a lumbar section. Each section may be contoured so that each of the separate features combine to create an overall effect which automatically sets a user up so that he or she is in most optimal position to produce power, execute proper form, and/or prevent injury. As a result, such embodiments may, by way of example and not limitation, reduce or eliminates the need for a user to use mental cues, to remember to create the necessary points of contact with the bench for proper stability, force generation, and/or the production of efficient movements. Accordingly, such embodiments may provide a platform that automatically incorporates efficient movements so the use of proper form (e.g., in weightlifting) is instinctual and/or common injuries (e.g., rotator cuff injury, scapular injury, shoulder strain, lower back injury, and tendonitis) are less frequent.

In some embodiments, when a PSD is coupled onto the bench, it may, for example, create a three-dimensional (3D) contoured surface. The 3D surface is configured so that when a user lays on it (e.g., on their back), and engages the weight (e.g., a barbell, dumbbells), the 3D surface creates causes the user's head, back, buttocks, shoulders, hips, and/or legs to align in a biomechanically advantageous configuration. An overall convex transverse contour may, for example, advantageously support the user's back and cause a user's shoulders to rotate rearwards (relative to a frontal plane of the user). Thus, when force is applied on a user's arms (e.g., by lifting a weight) the user's shoulders may advantageously rotate rearwards until they are pressed against the transverse convex surface of the PSD. The user's head may rest on a downward sloping surface with their buttocks positioned (at least partially) on or just distal to the downward sloping surface (e.g., such that their lower back is supported by the lumbar section). Accordingly, the 3D surface advantageously supports the natural curvature of the spine, positioning of the head, positioning of the legs, position and/or motion of the scapulae, thereby placing a user in optimal position to execute a multitude of efficient movement patterns. Furthermore, energy leaks, injury, and/or discomfort caused by gaps between the user's body and points of contact with the bench may be advantageously reduced and/or eliminated.

In various embodiments a 3D contoured shape of a PSD may provide a unique advantage in teaching and/or enforcement of proper mechanics for a variety of movements. For example, coaches and/or trainers in schools, gyms, fitness facilities, and/or sports facilities may advantageously train students in proper form simply by using the PSD. A PSD may, for example, be configured to force a user to assume proper form. Accordingly, the need for one to use mental cues and/or make a conscious effort to set up and execute properly may be advantageously reduced and/or removed. Therefore, such embodiments may simplify the teaching process and/or remove the need for constant supervision. Injuries and/or bad habits formed by exercise with improper form while a coach/trainer's attention is elsewhere (e.g., on another student) may be advantageously reduced or eliminated.

Curvature (e.g., a transverse convex profile) of a PSD may induce instinctual locking of the scapulae in retraction and/or depression to initiate pressing movements. As a result, pressure on the user's shoulder joints may be advantageously reduced. Furthermore, a user's arms may be able to move more freely, which may, for example, simultaneously isolate the working muscle. Accordingly, an advantage for maximum muscle fiber recruitment may, for example, be provided.

A PSD may, for example, increase the user's range of motion and/or offer increased isolation to the muscles of the back (e.g., of the lats and traps) when the user performs pulling movements, such as chest supported row movements with dumbbells, seal rows, barbell chest supported rows, or some combination thereof as described in more detail later.

In various embodiments a PSD may be configured to be extremely versatile and/or may be configured as an accessory to one or more existing benches and/or machines (e.g., plate loaded, weight stack). A PSD may, for example, deployed on machines and/or benches (stationary and adjustable); Olympic incline, decline, and/or flat benches, or on the floor; in commercial gyms, private gyms, and home gyms; or some combination thereof.

In various embodiments a PSD may, for example, be configured for use in pushing, pulling, glute movements, execution of select lower body exercises, used by itself, in isolation, (not fastened to a bench or machine) for the execution of floor presses and various abdominal exercises, or some combination thereof.

A PSD may, for example, be configured to improve scapular stabilization and movement during pushing exercises. The combination of unique geometric features may open up the user's chest and/or offer support to the user's shoulders. Accordingly, it may advantageously provide a user with superior range of motion and superior feel to the exercise.

A multi-directional 3D curvature of a PSD may, by way of example and not limitation, advantageously increase a user's range of motion, pin the shoulder shoulders back, and/or support a user's spine and/or lumbar region. The combination of the increased range of motion, proper position of the torso, increased support (e.g., trunk, spine, and/or scapular stabilization), or some combination thereof, may reduce unnecessary stress caused by improper form and/or range of motion restriction often experienced during exercise (e.g., with flat benches, instability-inducing benches). As a result, various embodiments may advantageously reduce the occurrence of common joint injuries (e.g., shoulder joint injuries) associated with pushing movements.

In various embodiments a PSD 105 may also, by way of example and not limitation, be configured for pulling motions. Various 3D curvatures of a PSD 105 may, for example, be configured to exaggerate a row movement. The curvature may permit a user's arms and/or shoulders to move freely in protraction and/or retraction. Accordingly, a user may automatically learn, by use of a PSD 105 to initiate a pull movement with the working muscle by, for example, first protracting (to create tension on the target muscle) and then retracting their scapula. An increased range of motion provided by the PSD 105 may advantageously encourage maximum muscle fiber recruitment. The increased range of motion may create deliberate stretches to the muscle in its lengthened state. Accordingly, a user may automatically learn proper form and/or proper execution through training with a PSD 105.

In various embodiments a PSD 105 may, for example, be configured for shoulder and/or arm work. For example, 3D contouring of a PSD 105 may be configured to automatically lock a user's shoulders in place, thereby stabilizing the shoulder complex. Extraneous movement may, therefore, advantageously be removed from corresponding exercise(s). Stability at the trunk and shoulder complex may ensure tension is in a desired place.

In various embodiments a PSD 105 may be configured for use with lower body movements. Such lower body movements may include, by way of example and not limitation, movements to train the gluteal musculature. A 3D curvature(s) of a PSD 105 may, for example, increase a range of motion for the glute bridge and/or hip thrust movements. The curvature may advantageously permit a user to isolate their hips and/or move them into deeper extension while maintaining a flat back with only his or her shoulders and/or upper trapezius in direct contact with the bench through the full range of motion. Such embodiments may advantageously enable such biomechanical advantages which are not possible on a flat bench. An increased range of motion provided by the PSD 105 may, for example, allow increased (e.g., maximum) muscle fiber recruitment; harder, more effective contractions to the muscle in its shortened state; extremely deliberate and/or effective stretches to the muscle in its lengthened state; or some combination thereof. A user's ability to build their glutes may be directly related to their ability to create hard contractions. Hard contractions may be (substantially entirely) dependent on stability of the user. Stability may be a function of a user's ability to (a) move their knees and spine (e.g., increased movement ability corresponding to decreased stability), and (b) just move the hip joint. Various embodiments may advantageously provide such stability during glute-related movements.

In some embodiments, a PSD (e.g., the PSD 105) may, for example, be (releasably) coupled to a user body support member of a leg extension device. For example, the PSD may be coupled to align with a user's back (such as shown in FIG. 12). The PSD may, for example, enforce proper posture (e.g., sitting upright instead of 'slouching'). For example, an offset (e.g., distance 240) between the torso support surface (e.g., support surface 230) and the lumbar support surface (e.g., support surface 235 and/or distal positioning surface 210) may advantageously induce a desired curvature of the thoracic and/or lumbar spine. The PSD may, for example, stabilize a user's torso (e.g., to prevent rocking side to side). The PSD may, for example, provide support and/or positioning for a user's shoulders (e.g., via the shoulder support surfaces such as, for example, lateral positioning surface 215). The PSD may, for example, prevent (undesired) motion of a user's buttocks during leg extension. Accordingly, the PSD may, for example, advantageously enable greater isolation of quadricep muscles.

Various embodiments may be adjustable. Some embodiments may be provided with (electronic and/or electromechanical) sensors, communication modules, controllers, and/or actuators. Examples of some such embodiments are disclosed at least with reference to [0033-0047] of U.S. Provisional Application Ser. No. 63/152,903, titled "Biomechanical Positioning Exercise Apparatus," filed by Andrew Harvot on Feb. 24, 2021, the entire contents of which are incorporated herein by reference.

For example, some embodiments may be provided with at least one communication module (e.g., near field communication such as Bluetooth). Some embodiments may, for example, be provided with one or more proprioceptive sensors. Various embodiments may be configured to connect with an app (e.g., operating on a smartphone, tablet, computer). The communication module may, for example, provide feedback from the proprioceptive sensors to the app. A user may, for example, monitor feedback on the app to improve exercise (e.g., positioning, motion, force, action sequences).

In some embodiments a controller may be configured with predetermined adjustments (e.g., configured for a particular user, a particular purpose). For example, a user may manually and/or automatically (e.g., according to the predetermined adjustments) configure a PSD 105 via the controller. The controller may, for example, include and/or communicate (e.g., via the communication module) with a wirelessly and/or remote device (e.g., a smartphone, laptop, computer).

In various embodiments, some bypass circuits implementations may be controlled in response to signals from analog or digital components, which may be discrete, integrated, or a combination of each. Some embodiments may include programmed, programmable devices, or some combination thereof (e.g., PLAs, PLDs, ASICs, microcontroller, microprocessor), and may include one or more data stores (e.g., cell, register, block, page) that provide single or multi-level digital data storage capability, and which may be volatile, non-volatile, or some combination thereof. Some control functions may be implemented in hardware, software, firmware, or a combination of any of them.

Computer program products may contain a set of instructions that, when executed by a processor device, cause the processor to perform prescribed functions. These functions may be performed in conjunction with controlled devices in operable communication with the processor. Computer program products, which may include software, may be stored in a data store tangibly embedded on a storage medium, such as an electronic, magnetic, or rotating storage device, and may be fixed or removable (e.g., hard disk, floppy disk, thumb drive, CD, DVD).

Temporary auxiliary energy inputs may be received, for example, from chargeable or single use batteries, which may enable use in portable or remote applications. Some embodiments may operate with other DC voltage sources, such as batteries, for example. Alternating current (AC) inputs, which may be provided, for example from a 50/60 Hz power port, or from a portable electric generator, may be received via a rectifier and appropriate scaling. Provision for AC (e.g., sine wave, square wave, triangular wave) inputs may include a line frequency transformer to provide voltage step-up, voltage step-down, and/or isolation.

Although particular features of an architecture have been described, other features may be incorporated to improve performance. For example, caching (e.g., L1, L2, . . . ) techniques may be used. Random access memory may be included, for example, to provide scratch pad memory and or to load executable code or parameter information stored for use during runtime operations. Other hardware and software may be provided to perform operations, such as network or other communications using one or more protocols, wireless (e.g., infrared) communications, stored operational energy and power supplies (e.g., batteries), switching and/or linear power supply circuits, software maintenance (e.g., self-test, upgrades), and the like. One or more communication interfaces may be provided in support of data storage and related operations.

Some systems may be implemented as a computer system that can be used with various implementations. For example, various implementations may include digital circuitry, analog circuitry, computer hardware, firmware, software, or combinations thereof. Apparatus can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Various embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, which may include a single processor or one of multiple processors of any kind of computer. Generally, a processor will receive instructions and data from a read-only memory or a random-access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and CD-ROM and DVD-ROM disks. The processor and the memory can be supplemented by, or incorporated in, ASICs (application-specific integrated circuits).

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. Various embodiments may be implemented in a computer system that includes a graphical user interface and/or an Internet browser. To provide for interaction with a user, some implementations may be implemented on a computer having a display device, such as a CRT (cathode ray tube) or LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, the computers and networks forming the Internet, or some combination thereof. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Firewire, ATA/IDE, RS-232, RS-422, RS-485, 802.11 a/b/g, Wi-Fi, Ethernet, IrDA, FDDI (fiber distributed data interface), token-ring networks, multiplexing techniques based on frequency, time, or code division, or some combination thereof. Some implementations may optionally incorporate features such as error checking and correction (ECC) for data integrity, or security measures, such as encryption (e.g., WEP) and password protection.

In various embodiments, the computer system may include Internet of Things (IoT) devices. IoT devices may include objects embedded with electronics, software, sensors, actuators, and network connectivity which enable these objects to collect and exchange data. IoT devices may be in-use with wired or wireless devices by sending data through an interface to another device. IoT devices may collect useful data and then autonomously flow the data between other devices.

Various examples of modules may be implemented using circuitry, including various electronic hardware. By way of example and not limitation, the hardware may include transistors, resistors, capacitors, switches, integrated circuits, other modules, or some combination thereof. In various examples, the modules may include analog logic, digital logic, discrete components, traces and/or memory circuits fabricated on a silicon substrate including various integrated circuits (e.g., FPGAs, ASICs), or some combination thereof. In some embodiments, the module(s) may involve execution of preprogrammed instructions, software executed by a processor, or some combination thereof. For example, various modules may involve both hardware and software.

In an illustrative aspect, a body positioning and support system (BPS S) may include a torso module. The torso module may include a torso support surface extending in a first plane along a longitudinal axis. The torso module may include a neck support surface extending from a proximal end of the torso support surface. The torso module may include a shoulder support surface extending from each side of the torso support surface in opposite directions along a transverse axis orthogonal to the longitudinal axis in the first plane. The BPSS may include a lumbar module. The lumbar module may include a lumbar support surface distal to the torso support surface. The shoulder support surfaces may each be defined by a first offset from the first plane towards a base plane of the torso module. The first offset may monotonically increase along the transverse axis relative to increasing distance from the longitudinal axis. The lumbar support surface may be displaced from the first plane towards the base plane by at least a second offset. The BPSS may be configured such that at least a portion of a dorsum of a user is supported by the torso support surface and a posterior lumbar region of the user is supported by the lumbar support surface, and when the user applies an upward force, then scapulae of the user may be automatically depressed and adducted until shoulders of the user are supported by the shoulder support surfaces.

The second offset may monotonically increase in the distal direction for at least a portion of the lumbar support surface. The neck support surface may be at least partially defined by a third offset from the first plane towards the base plane, wherein the third offset is monotonically increasing in the proximal direction. The first offset may be linearly increasing along the transverse axis relative to increasing distance from the longitudinal axis.

The torso support surface may have a substantially uniform width in the first plane and orthogonal to the longitudinal axis. A minimum of the second offset may be greater than the minimum first offset.

The lumbar module may be adjustably coupled to the torso module such that a user may adjust a distance parallel to the longitudinal axis between the neck support surface and the lumbar support surface.

The BPSS may include a hinge module such that the torso module is pivotably coupled to the lumbar module. The hinge module may divide the torso module into an upper torso module and a lower torso module.

The BPSS may include a weight training frame.

The BPSS may include a coupling module configured to releasably couple at least one of the torso module and the lumbar module to an exercise apparatus.

In an illustrative aspect, a body positioning and support system (BPSS) may include a torso support surface extending in a first plane along a longitudinal axis. The BPSS may include a neck support surface extending from a proximal end of the torso support surface. The BPSS may include a shoulder support surface extending from each side of the torso support surface in opposite directions along a transverse axis orthogonal to the longitudinal axis in the first plane. The BPSS may include a lumbar support surface distal to the torso support surface. The shoulder support surfaces may each be defined by a first offset from the first plane towards a base plane. The first offset may monotonically increase along the transverse axis relative to increasing distance from the longitudinal axis. The lumbar support surface may be displaced from the first plane towards the base plane by at least a second offset.

When at least a portion of a dorsum of a user is supported by the torso support surface and a posterior lumbar region of the user is supported by the lumbar support surface, and when the user applies an upward force, then scapulae of the user may be automatically depressed and adducted until shoulders of the user are supported by the shoulder support surfaces.

The second offset may monotonically increase in the distal direction for at least a portion of the lumbar support surface. The neck support surface may be at least partially defined by a third offset from the first plane towards the base plane. The third offset may be monotonically increasing in the proximal direction. The first offset may be linearly increasing along the transverse axis relative to increasing distance from the longitudinal axis. The torso support surface may have a substantially uniform width in the first plane and orthogonal to the longitudinal axis. A minimum of the second offset may be greater than the minimum first offset.

In an illustrative aspect, a body positioning and support system (BPSS) may include a torso module. The torso module may include a first surface extending in a first plane along a longitudinal axis. The torso module may include a second surface extending from a proximal end of the first surface. The torso module may include a third surface and a fourth surface, each extending from opposite sides of the first surface in opposite directions along a transverse axis orthogonal to the longitudinal axis in the first plane. The BPSS may include a lumbar module. The lumbar module may include a fifth surface distal to the first surface. The third surface and the fourth surface may each be defined by a first offset from the first plane towards a base plane of the torso module. The first offset may monotonically increase along the transverse axis relative to increasing distance from the longitudinal axis. The fifth surface is displaced from the first plane towards the base plane by at least a second offset.

At least one of the torso module and the lumbar module may be configured such that, when at least a portion of a dorsum of a user is supported by the first surface and a posterior lumbar region of the user is supported by the fifth surface, and when the user applies an upward force, then scapulae of the user are automatically depressed and adducted until shoulders of the user are supported by the third surface and the fourth surface.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A body positioning and support system comprising:

a torso module comprising:

a torso support surface extending in a first plane along a longitudinal axis;

a neck support surface extending from a proximal end of the torso support surface; and, a shoulder support surface extending from each side of the torso support surface in opposite directions along a transverse axis orthogonal to the longitudinal axis in the first plane; and, a lumbar module comprising a lumbar support surface distal to the torso support surface, wherein:

the shoulder support surfaces are each defined by a first offset from the first plane towards a base plane of the torso module, the first offset monotonically increasing along the transverse axis relative to increasing distance from the longitudinal axis, and the lumbar support surface is displaced from the first plane towards the base plane by at least a second offset, such that, when at least a portion of a dorsum of a user is supported by the torso support surface and a posterior lumbar region of the user is supported by the lumbar support surface, and when the user applies an upward force, then scapulae of the user are automatically depressed and adducted until shoulders of the user are supported by the shoulder support surfaces.

2. The system of claim 1, wherein the second offset is monotonically increasing in the distal direction for at least a portion of the lumbar support surface.

3. The system of claim 1, wherein the neck support surface is at least partially defined by a third offset from the first plane towards the base plane, wherein the third offset is monotonically increasing in a proximal direction.

4. The system of claim 1, wherein the first offset is linearly increasing along the transverse axis relative to increasing distance from the longitudinal axis.

5. The system of claim 1, wherein the torso support surface has a substantially uniform width in the first plane and orthogonal to the longitudinal axis.

6. The system of claim 1, wherein a minimum of the second offset is greater than the minimum first offset.

7. The system of claim 1, wherein the lumbar module is adjustably coupled to the torso module such that a user may adjust a distance parallel to the longitudinal axis between the neck support surface and the lumbar support surface.

8. The system of claim 1, further comprising a hinge module such that the torso module is pivotably coupled to the lumbar module.

9. The system of claim 8, wherein the hinge module divides the torso module into an upper torso module and a lower torso module.

10. The system of claim 1, further comprising a weight training frame.

11. The system of claim 1, further comprising a coupling module configured to releasably couple at least one of the torso module and the lumbar module to an exercise apparatus.

12. A body positioning and support system comprising:

a torso support surface extending in a first plane along a longitudinal axis;

a neck support surface extending from a proximal end of the torso support surface;

a shoulder support surface extending from each side of the torso support surface in opposite directions along a transverse axis orthogonal to the longitudinal axis in the first plane; and, a lumbar support surface distal to the torso support surface, wherein:

the shoulder support surfaces are each defined by a first offset from the first plane towards a base plane, the first offset monotonically increasing along the transverse axis relative to increasing distance from the longitudinal axis, and the lumbar support surface is displaced from the first plane towards the base plane by at least a second offset.

13. The system of claim 12, wherein, when at least a portion of a dorsum of a user is supported by the torso support surface and a posterior lumbar region of the user is supported by the lumbar support surface, and when the user applies an upward force, then scapulae of the user are automatically depressed and adducted until shoulders of the user are supported by the shoulder support surfaces.

14. The system of claim 12, wherein the second offset is monotonically increasing in the distal direction for at least a portion of the lumbar support surface.

15. The system of claim 12, wherein the neck support surface is at least partially defined by a third offset from the first plane towards the base plane, wherein the third offset is monotonically increasing in a proximal direction.

16. The system of claim 12, wherein the first offset is linearly increasing along the transverse axis relative to increasing distance from the longitudinal axis.

17. The system of claim 12, wherein the torso support surface has a substantially uniform width in the first plane and orthogonal to the longitudinal axis.

18. The system of claim 12, wherein a minimum of the second offset is greater than the minimum first offset.

19. A body positioning and support system comprising:

a torso module comprising:

a first surface extending in a first plane along a longitudinal axis;

a second surface extending from a proximal end of the first surface; and, a third surface and a fourth surface, each extending from opposite sides of the first surface in opposite directions along a transverse axis orthogonal to the longitudinal axis in the first plane; and, a lumbar module comprising a fifth surface distal to the first surface, wherein:

the third surface and the fourth surface are each defined by a first offset from the first plane towards a base plane of the torso module, the first offset monotonically increases along the transverse axis relative to increasing distance from the longitudinal axis, and the fifth surface is displaced from the first plane towards the base plane by at least a second offset.

20. The system of claim 19, wherein:

at least one of the torso module and the lumbar module are configured such that, when at least a portion of a dorsum of a user is supported by the first surface and a posterior lumbar region of the user is supported by the fifth surface, and when the user applies an upward force, then scapulae of the user are automatically depressed and adducted until shoulders of the user are supported by the third surface and the fourth surface.

* * * * *